US008590700B2

(12) United States Patent
Yang et al.

(10) Patent No.: US 8,590,700 B2
(45) **Date of Patent: *Nov. 26, 2013**

(54) SLEEVED TO PRESS-OPEN TYPE STORAGE DEVICE WITH A PRESTRESSED TO OPEN CLOSURE

(76) Inventors: Tai-Her Yang, Dzan-Hwa (TW); Yang Chen, Taipei (TW)

( * ) Notice: Subject to any disclaimer, the term of this patent is extended or adjusted under 35 U.S.C. 154(b) by 147 days.

This patent is subject to a terminal disclaimer.

(21) Appl. No.: 12/081,511

(22) Filed: Apr. 17, 2008

(65) Prior Publication Data

US 2009/0260999 A1 Oct. 22, 2009

(51) Int. Cl.
*B65D 25/08* (2006.01)

(52) U.S. Cl.
USPC ..... 206/222; 206/219; 206/220

(58) Field of Classification Search
USPC ..... 206/219, 221, 222; 215/11.1; 222/212
See application file for complete search history.

(56) References Cited

U.S. PATENT DOCUMENTS

| | | | | | |
|---|---|---|---|---|---|
| 3,347,410 | A * | 10/1967 | Schwartzman | ..... | 222/80 |
| 4,982,875 | A * | 1/1991 | Pozzi et al. | ..... | 222/83 |
| 5,927,549 | A * | 7/1999 | Wood | ..... | 222/83 |
| 6,138,821 | A * | 10/2000 | Hsu | ..... | 206/222 |
| 6,302,268 | B1 * | 10/2001 | Michaeli | ..... | 206/221 |
| 7,568,576 | B2 * | 8/2009 | Sweeney et al. | ..... | 206/219 |
| 7,635,012 | B2 * | 12/2009 | Johns et al. | ..... | 141/322 |
| 2001/0001196 | A1 * | 5/2001 | Hawthorne | ..... | 206/219 |
| 2005/0263414 | A1 * | 12/2005 | Harilela et al. | ..... | 206/221 |
| 2006/0118435 | A1 * | 6/2006 | Cronin et al. | ..... | 206/219 |
| 2007/0074979 | A1 * | 4/2007 | Cho | ..... | 206/219 |

* cited by examiner

*Primary Examiner* — J. Gregory Pickett
*Assistant Examiner* — Kaushikkumar Desai
(74) *Attorney, Agent, or Firm* — Bacon & Thomas, PLLC

(57) ABSTRACT

The present invention discloses a sleeved to press-open type storage device with a prestressed to open closure having the closure and one side of the storage device connectedly attached by a flexible flake type structure, wherein it is characterized in that the relative stable relationship is that when the closure is closed relative to the storage device, the connecting flake type structure is bent to appear a prestressed status to opening direction thereby keeping the closure to remain at a stable opening status after it is pressed to open.

14 Claims, 4 Drawing Sheets

SLEEVED TO PRESS-OPEN TYPE STORAGE DEVICE WITH A PRESTRESSED TO OPEN CLOSURE

BACKGROUND OF THE INVENTION (a) Field of the Invention

The present invention is related to a sleeved to press-open type storage device with a prestressed to open closure which is an innovative cylinder, cylinder like, or multi-face can shaped hollow container structure for storing particle, powder, slurry, paste, liquid, or dissolvable solid type contents, wherein the peripheral side of the can shaped shell body having flanges for insertingly attaching with the edges of the opening portion is inserted into the opening portion of the selected container, while the position of the force bearing surface for press-open closure to be applied on by an external force on the shell body of a hollow container and the position of the content dispense outlet are respectively made at the two axial ends of the shell body of the hollow can type container. The closure is combined with the content dispense outlet, wherein when they are inserted into the opening portion of the selected container, the force bearing surface at one end is forced to open the closure at the other end to dispense contents, or naturally, the closure at the other end can be opened by hand as required to let the force bearing surface be forced to dispense contents or to directly pour out contents, or after the closure is opened by hand and placed into selected container, by the contact of the dissolvable solid type contents and the liquid or air inside the selected container, the solid type contents thereof dissolves. Further, a flexible flake type structure is made between the closure and the shell body of a hollow container to prevent the closure and the shell body from detachment, wherein the relatively stable relationship between the closure and shell body is that when the closure relative to the storage device appears a close status, the attaching flake type structure is bent to appear a prestressed status to the opening direction so that the closure can be kept at a stable opening status to avoid hindering the dispense of contents inside the shell body of the hollow container, whereas the closure is not detached from the shell body so as to mix with the dispensed contents after it is opened, therefore it is good for recycle and that is the progressiveness of the innovative design of the present invention.

(b) Description of the Prior Art

The closure of conventional hand or mechanism holding type hollow container for storing particle, powder, slurry, paste or liquid like contents is usually independently provided, wherein it has at least one of imperfections including: 1) container and closure are at detachment status and are more inconvenient for recollection; or 2) if the press dispense is by side pressing, then the side pressured surface is wide enough to be mistakenly pressed; or 3) The position relationship between the opened closure and shell body is unstable thereby affecting dispense of contents.

SUMMARY OF THE INVENTION

The sleeved to press-open type storage device with a prestressed to open closure of the present invention is a cylinder, cylinder-like, or multi-faced can type hollow container for storing particle, powder, slurry, paste, liquid or dissolvable solid type contents, wherein the peripheral side of the can shaped shell body having flanges for insertingly attaching with the edges of the opening portion is particularly made for inserting into the opening portion of the selected container, while the position of the force bearing surface for press-open closure to be applied on by an external force on the shell body of a hollow container and the position of content dispense outlet are respectively made at the two axial ends of the shell body of the hollow can type container. The closure is combined with the content dispense outlet, wherein when they are inserted into the opening portion of the selected container, the force bearing surface at one end is forced to open the closure at the other end to dispense contents, or naturally, the closure at the other end can be opened by hand as required to let the force bearing surface be forced to dispense contents or to directly pour out contents, or after the closure is opened by hand and placed into selected container, by the contact of the dissolvable solid type contents and the liquid or air inside the selected container, the solid type contents thereof dissolves. Further, a flexible flake type structure is made between the closure and the storage device to prevent the closure and the shell body from detachment, wherein the relatively stable relationship between the closure and shell body is that when the closure relative to the storage device appears a close status, the attaching flake type structure is bent to appear a prestressed status to the opening direction so that the closure can be kept at a stable opening status to avoid hindering the dispense of contents inside the shell body of the hollow container, whereas the closure is not detached from the shell body so as to mix with the dispensed contents after it is opened, therefore it is convenient for recycle.

DESCRIPTION OF MAIN COMPONENT SYMBOLS

Figure 1:
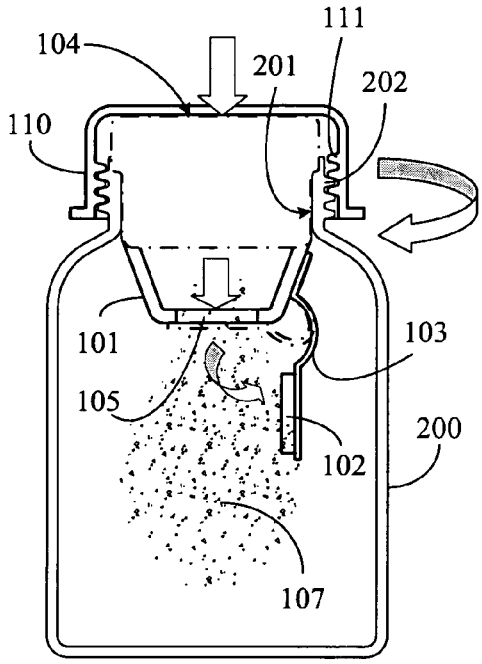
FIG. 1 is a cross-sectional view showing the main structure of the invention.

101: Shell body
102: Closure
103: Flexible flake type structure

104: Force bearing structure
105: Dispense outlet
106: Pushing structure
107: Contents
108: Piston structure
109: Dog
110: Container cap
111: Inner thread
200: Selected container
201: Opening portion
202: External thread

DETAILED DESCRIPTION OF THE PREFERRED EMBODIMENTS

The conventional press-open type storage device has the following three types of relative imperfections:

1. The press-open type closure is detached from the storage device after being pressed so as to mix with the stored contents;

2. The press-open type closure is not completely detached after being pressed to open, when the pressing pressure disappears, the closure is bounced back to hider the dispense of contents;

3. If the press-open type closure is opened by applying an instant pressure to deform the storage device, whereas the closure is partially opened to release the pressure immediately, and the closure can still be bounced back.

The present invention is related to a sleeved to press-open type storage device with a prestressed to open closure which is an innovative cylinder, cylinder like, or multi-face can shaped hollow container structure for storing particle, powder, slurry, paste, liquid, or dissolvable solid type contents, wherein the peripheral side of the can shaped shell body having flanges for insertingly attaching with the edges of the opening portion is inserted into the opening portion of the selected container, while the position of the force bearing surface for press-open closure to be applied on by an external force of the shell body of a hollow container and the position of the content dispense outlet are respectively made at the two axial ends of the shell body of the hollow can type container. The closure is combined with the content dispense outlet, wherein when they are inserted into the opening portion of the selected container, the force bearing surface at one end is forced to open the closure at the other end to dispense contents, or naturally, the closure at the other end can be opened by hand as required to let the force bearing surface be forced to dispense contents or to directly pour out contents, or after the closure is opened by hand and placed into selected container, by the contact of the dissolvable solid type contents and the liquid or air inside the selected container, the solid type contents thereof dissolves. Further, a flexible flake type structure is made between the closure and the shell body of a hollow container to prevent the closure and the shell body from detachment, wherein the relatively stable relationship between the closure and shell body is that when the closure relative to the storage device appears a close status, the attaching flake type structure is bent to appear a prestressed status to the opening direction so that the closure can be kept at a stable opening status to avoid hindering the dispense of contents inside the shell body of the hollow container, whereas the closure is not detached from the shell body so as to mix with the dispensed contents after it is opened, therefore it is good for recycle and that is the progressiveness of the innovative design of the present invention.

FIG. 1 is a cross-sectional view showing the main structure of the invention.

As illustrated in FIG. 1, it mainly comprises:

A shell body (101): It is a cylinder, cylinder like or multi-faced can type hollow container made of plastic or metal for storing particle, powder, slurry, paste, liquid or dissolvable solid type contents (107), wherein the peripheral side of the shell body (101) of a hollow container having flanges for insertingly attaching with the edges of opening portion of the container is inserted into the opening portion (201) of selected container (200), and the shell body (101) of a hollow container being made with a dispense outlet (105) at the axial bottom end thereof is at a close status when the dispense outlet (105) is combined with a closure (102), and dispenses contents (107) when said closure (102) is opened. Further, the shell body of the hollow container being attached with the flexible flake type structure (103) allows the position of said closure (102) to be at opening status in ordinary conditions and to appear a prestressed toward opening direction status when it is combined with the dispense outlet (105). Furthermore, the shell body of a hollow container can be selected as needed to be made with a force bearing structure (104) at the axial top end thereof, wherein when it is applied on by an external force, the closure (102) is pressed to open to dispense contents, or naturally, the closure at the other end can be opened by hand and let the force bearing surface be forced to dispense contents or to directly pour out contents;

A closure (102): It appears a closure structure to matchingly combined with the dispense outlet (105) at bottom end of the shell body (101) to make the two appear a closing combined status, when the force bearing structure (104) is applied by an external force, the closure (102) is pressed to detach with the dispense outlet (105) to dispense contents, or the closure at the other end is opened by hand as required to apply force on the force bearing surface to dispense contents or to directly pour out contents, wherein the closing combining methods for said closure (102) and shell body (101) include: 1) plugging combination 2) in-laying combination 3) locking combination 4) adhering combination 5) fusion combination or clamping combination by additional auxiliary locking elements, etc.;

The definition of closing combination of said closure (102) and dispense outlet (105) of shell body (101) includes a full close status or semi-close status and is dependent on the property and the preservation requirement of the contents stored inside the shell body (101);

A flexible flake type structure (103): It is constituted by a flexible flake type attaching structure made of flexible material for attaching the shell body (101) and the closure (102), wherein the attaching status of said shell body (101) and closure (102) includes that when the closure (102) is combined with the dispense outlet (105) at bottom end of the shell body (101) to allow the shell body (101) as a container to appear a close status, the flexible flake type structure (103) is bent to a prestressed status to the opening direction, wherein the closure (102) detaches from the shell body (101) and is helped by the prestressed flexibility of the flexible flake type structure (103) to allow the dispense outlet (105) at bottom end of the shell body (101) to maintain at a stable opening status to dispense contents (107), while the closure (102) is through the flexible flake type structure (103) to be still attached to the shell body (101) without falling down.

The structural relationships between the shell body (101), closure (102) and flexible flake type structure (103) of the sleeved to press-open type storage device with a prestressed to open closure include:

1. The flexible flake type structure (103), closure (102) and shell body (101) are made of the same material and are integrally formed; or 2. The closure (102) and flexible flake type structure (103) are made of the same material and integrally formed to further combine with the shell body (101) made of the same material; or 3. The closure (102) and flexible flake type structure (103) are made of the same material and are integrally formed to further combine with the shell body (101) made of different material; or 4. The shell body (101) and flexible flake type structure (103) are made of the same material and are integrally formed to further combine with the closure (102) made of the same material; or 5. The shell body (101) and flexible flake type structure (103) are made of the same material and are integrally formed to further combine with the closure (102) made of different material; or 6. The shell body (101), closure (102) and flexible flake type structure (103) are made of the same material, wherein they are individually made and further combined; or 7. The shell body (101), closure (102) and flexible flake type structure (103) are made of different material, wherein they are individually made and further combined.

Figure 2:
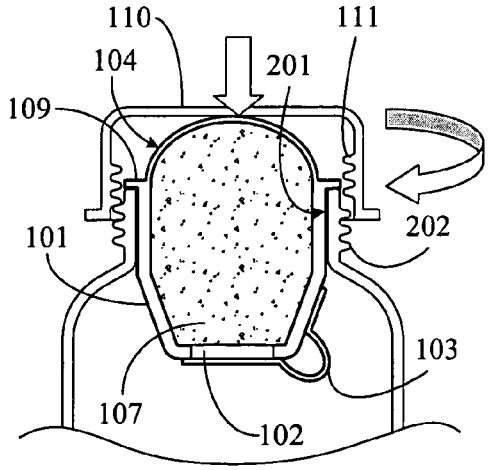
FIG. 2 is a cross-sectional view showing the embodiment of the force bearing structure which is made of a flexible material softer than shell body shown in FIG. 1.
Figure 3:
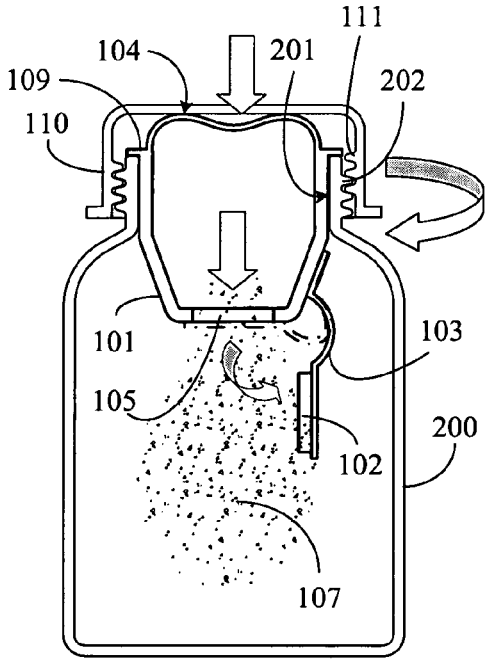
FIG. 3 is a cross-sectional view showing the force bearing structure of the shell body in the embodiment of FIG. 2 is forced to dispense contents of the shell body.
Figure 4:
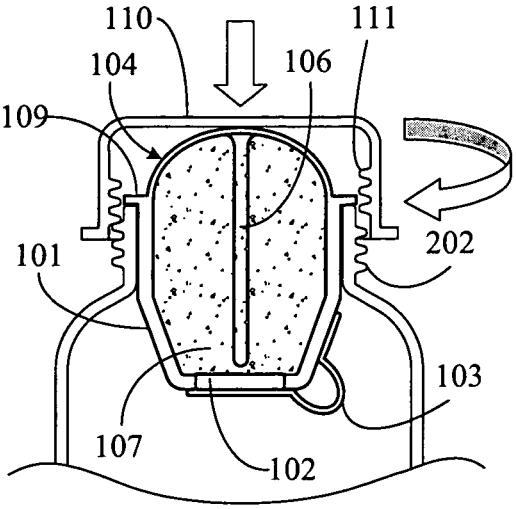
FIG. 4 is a cross-sectional view showing that the force bearing structure in the embodiment of FIG. 2 being combined inside the shell body pointing toward the closure has an extended pushing structure.
Figure 5:
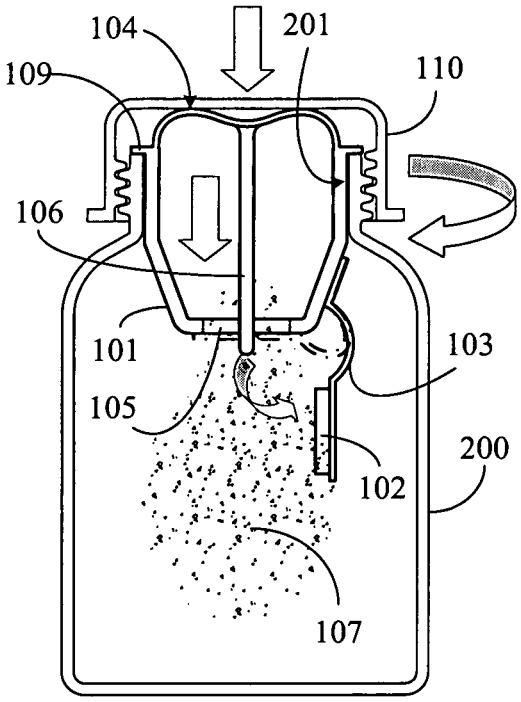
FIG. 5 is a cross-sectional view showing that the force bearing structure in the embodiment of FIG. 4 is forced to dispense the contents inside the shell body.
Figure 6:
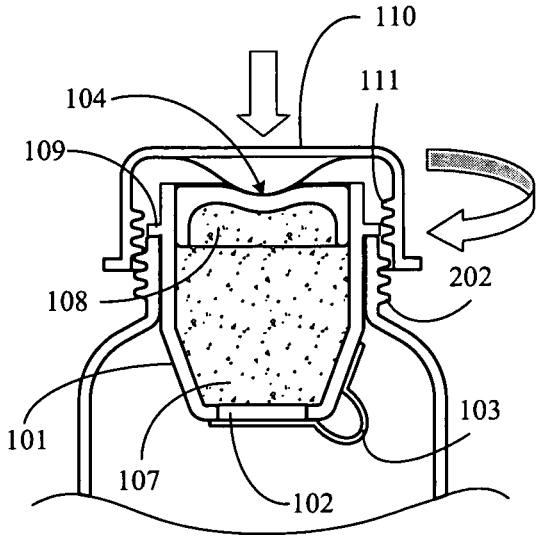
FIG. 6 is a cross-sectional view showing that the force bearing structure in the embodiment of FIG. 1 is constituted by the piston type structure.
Figure 7:
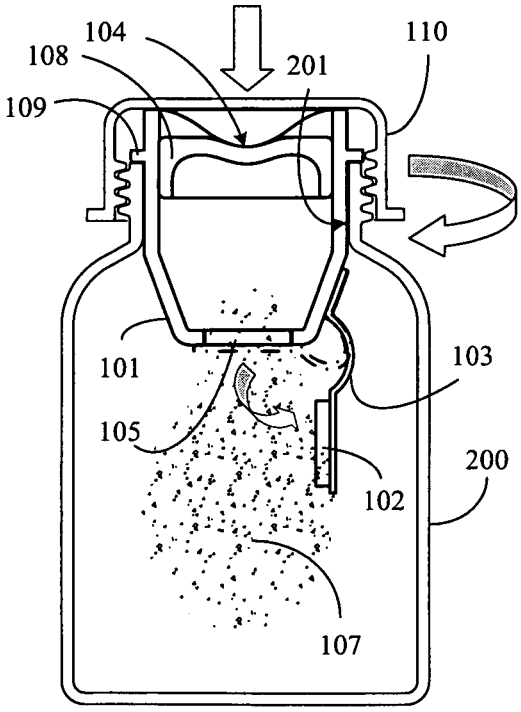
FIG. 7 is a cross-sectional view showing that the force bearing structure in the embodiment of FIG. 6 is pressed to open contents inside the shell body.

The combining methods for said shell body (101) and closure (102) as well as the combining methods for said closure (102) and flexible type structure (103) include: fusion combination, adhering combination, rivet combination, mechanism like in-lay or locking combination, clamping or sewing combinations by additional auxiliary elements, etc.;

The force bearing structure (104) of the sleeved to press-open type storage device with a prestressed to open closure can be embodied according to application requirements as following:

1. The force bearing surface of the force bearing structure (104) is constituted by a force bearing structure made of a flexible material softer than the one of shell body (101) to combine with the shell body (101), or is constituted by a force bearing structure (104) formed by a thinner flexible structure made of the same material as the one of shell body (101) to combine with said shell body (101), or is constituted by a force bearing structure (104) formed by a more flexible structure to combine with said shell body (101). In addition, the force bearing structure (104) and shell body (101) can be made of the same material to be integrally made or individually made and further combined, or they can be made of different material and further combined. For filling in the shell body interior with liquid, slurry or paste type content (107), said force bearing structure (104) is forced to deform thereby producing inner pressure to open the closure (102) which is further through the prestressed help by the flexible flake type structure (103) attached to the closure (102) and the shell body (101) to open and keep the closure (102) remaining at a stable opening status even after disappearance of pressure that is good for dispensing the filled in contents (107) in the interior of shell body (101). FIG. 2 is a cross-sectional view showing the embodiment of the force bearing structure which is made of a flexible material softer than shell body shown in FIG. 1. FIG. 3 is a cross-sectional view showing the force bearing structure of the shell body in the embodiment of FIG. 2 is forced to dispense contents of the shell body;

2. The force bearing structure (104) comprising an internally installed pushing structure (106) is made of a flexible material softer than the one of shell body (101) to be combined on the top portion of the shell body (101), wherein when the force bearing structure (104) having an extended pushing structure (106) being combined inside the shell body (101) pointing toward the closure (102) is forced, the pushing structure (106), which is a separate body that initially does not engage the closure (102) as depicted in FIG. 4, is provided for pushing toward the closure (102) thereby touchingly pressing the closure (102) combined with the dispense outlet (105) of the shell body (101) to open. The closure (102) is further through the prestressed help by the flexible flake type structure (103) attached to the closure (102) and shell body (101) to open and keep the closure (102) remaining at a stable opening status even after disengagement of the pushing structure (106) from the closure (102) as depicted in FIG. 5 and disappearance of pressure that is good for dispensing the filled in contents (107) in the interior of the shell body (101); FIG. 4 is a cross-sectional view showing that the force bearing structure in the embodiment of FIG. 2 being combined inside the shell body pointing toward the closure has an extended pushing structure; FIG. 5 is a cross-sectional view showing that the force bearing structure in the embodiment of FIG. 4 is forced to dispense the contents inside the shell body;

The force bearing structure (104) and the shell body (101) of the sleeved to press-open type storage device with a prestressed to open closure can be made of the same or different material to include:

a) The force bearing structure (104) and the shell body (104) are made of the same material and are integrally formed; or b) The force bearing structure (104) and the shell body (101) are respectively made of the same material and further combined; or c) The force bearing structure (104) and the shell body (101) are made of different material and are further combined;

3. The force bearing structure (104) can be constituted by a conventional piston type structure comprising a pushable piston structure (108), wherein when the piston structure (108) is forced to push forward, the particle, powder, liquid, slurry or paste type contents (107) filled in the shell body (101) are pressed to open the closure (102), while the closure (102) is maintained at an opening status without falling down through the prestressed flexible flake type structure (103). FIG. 6 is a cross-sectional view showing that the force bearing structure in the embodiment of FIG. 1 is constituted by the piston type structure. FIG. 7 is a cross-sectional view showing that the force bearing structure in the embodiment of FIG. 6 is pressed to open contents inside the shell body.

Figure 8:
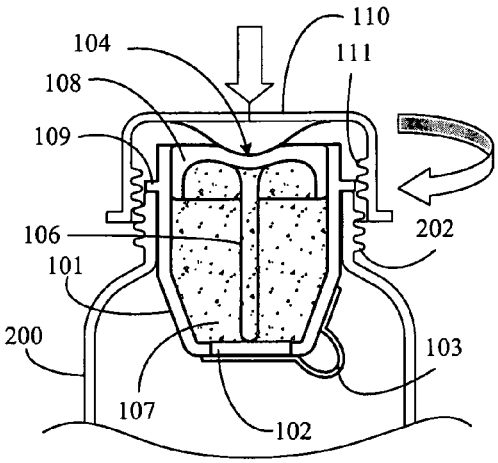
FIG. 8 is a cross-sectional view showing that the force bearing structure in the embodiment of FIG. 6 being combined inside the shell body pointing toward closure has an extended pushing structure.
Figure 9:
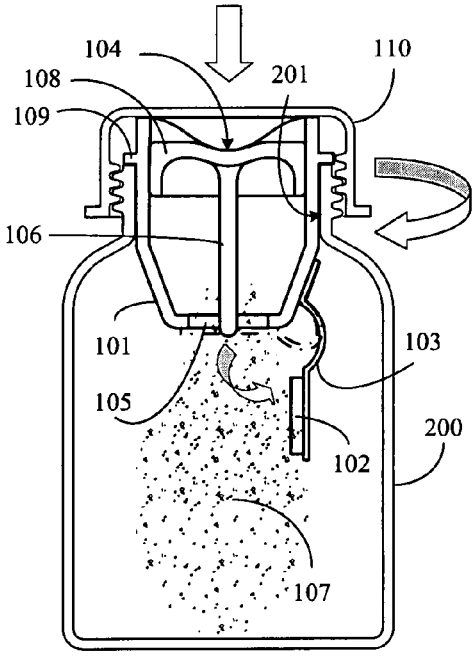
FIG. 9 is a cross-sectional view showing that the force bearing structure in the embodiment of FIG. 8 is pressed to open contents inside the shell body.

4. The force bearing structure (104) can be constituted by a conventional piston type structure comprising not only a pushable piston structure (108), but the piston structure (108) is also further provided with a pushing structure (106) along the direction toward the closure (102), wherein when the piston structure (108) is forced to push forward, said closure (102) is pressed to open through the push by said pushing structure (106), while said closure (102) is maintained at an opening status without falling down through the prestressed flexible flake type structure (103). FIG. 8 is a cross-sectional view showing that the force bearing structure in the embodiment of FIG. 6 being combined inside the shell body pointing toward closure has an extended pushing structure. FIG. 9 is a cross-sectional view showing that the force bearing structure in the embodiment of FIG. 8 is pressed to open contents inside the shell body.

As shown in FIGS. 1~9, the following force application methods and relatively matching external structure for the force bearing structure (104) relative to the shell body (101) can be selected according to different application condition herein:

1. The sleeved to press-open type storage device with a prestressed to open closure is for inserting into the opening portion (201) of the selected container (200), wherein when the interior of the shell body is filled with particle, powder, liquid, slurry, paste or dissolvable solid type contents (107) and the force bearing structure (104) is applied on by a human hand or an external force, or a mechanical, pneumatic or hydraulic force, said force bearing structure (104) is forced to deform thereby producing inner pressure to open the closure (102) which is further through the prestressed help by the flexible flake type structure (103) attached to the closure (102) and shell body (101) to open contents (107) inside the shell body (101) of the selected container (200) and keep said closure (102) remaining at a stable opening status even after disappearance of pressure, while the closure (102) is maintained at an opening status without falling down through the prestressed flexible flake type structure (103). In view of the applications, the outside diameter of the shell body (101) can be inserted into the opening portion (201) of the selected container (200) with proper tolerances, while peripheral side of the shell body (101) is made with a protruded ring type dog or a radially protruded block type dog (109) to limit the depth of insertion for inserting the shell body (101) into the opening portion (201) of the selected container and to form a limiting structure when it is pressed, wherein the selected container (200) can be empty without filling in contents or filled with particular contents;

2. The sleeved to press-open type storage device with a prestressed to open closure is for inserting into the opening portion (201) of the selected container (200), wherein the interior of the shell body is filled with particle, powder, liquid, slurry, paste or dissolvable solid type contents (107) and the force bearing structure (104) comprising an internally installed pushing structure (106) is made of a flexible material softer than the one of shell body (101) to be combined on the top portion of the shell body (101), while when the force bearing structure (104) having an extended pushing structure (106) being combined inside the shell body (101) pointing toward the closure (102) is forced by a human hand or an external force, or a mechanical force of mechanism, or a pneumatic or hydraulic force, the pushing structure (106) is pushed toward the closure (102) thereby touchingly pressing the closure (102) combined with the dispense outlet (105) of the shell body (101) to open, and said closure (102) is further through the prestressed help by the flexible flake type structure (103) attached to the closure (102) and shell body (101) to open contents (107) inside the shell body (101) of the selected container (200) and keep said closure (102) remaining at a stable opening status even after disappearance of pressure, while the closure (102) is maintained at an opening status without falling down through the prestressed flexible flake type structure (103). In view of the applications, the outside diameter of the shell body (101) can be inserted into the opening portion (201) of the selected container (200) with proper tolerances, while peripheral side of said shell body (101) is made with a protruded ring type dog or a radially protruded block type dog (109) to limit the depth of insertion for inserting said shell body (101) into the opening portion (201) of the selected container (200) and to form a limiting structure when it is pressed, wherein the selected container (200) can be empty without filling in contents or filled with particular contents;

3. The sleeved to press-open type storage device with a prestressed to open closure can be inserted into the opening portion (201) of the selected container (200), wherein the interior of the shell body is filled with particle, powder, liquid, slurry, paste or dissolvable solid type contents (107), and the opening portion (201) of the selected container (200) is provided with a container cap (110), wherein the container cap (110) having an inner thread (111) is threadly engaged with the external thread (202) at the outside of the opening portion (201) of the selected container and liquid or paste type contents are filled inside the shell body to exert tightening force on the force bearing structure (104) during the tread engagement, hence, said force bearing structure (104) is forced to deform thereby producing inner pressure to open said closure (102) which is further through the prestressed help by the flexible flake type structure (103) attached to the closure (102) and shell body (101) to open contents (107) inside the shell body (101) of the selected container (200) and keep said closure (102) remaining at a stable opening status even after disappearance of pressure, while the closure (102) is maintained at an opening status without falling down through the prestressed flexible flake type structure (103), wherein the selected container (200) can be empty without filling in contents or filled with particular contents. In view of the applications, the peripheral side of shell body (101) is made with a protruded ring type dog or a radially protruded block type dog (109), the outside diameter of the dog is slightly larger than the inside diameter of the opening portion (201) of the selected container (200) and is slightly smaller than the inside diameter of the container cap (110) so as to limit the depth of insertion for inserting the shell body (101) into the opening portion (201) of the selected container (200) and to form a limiting structure when it is pressed, while the outside diameter of the force bearing structure (104) at the top end of the shell body (101) is also slightly smaller than the inside diameter of the container cap (110) so as to avoid hindering the thread insertion by the container cap (110) into the opening portion (201) of the selected container (200) for tightening advancement;

4. The sleeved to press-open type storage device with a prestressed to open closure can be inserted into the opening portion (201) of the selected container (200), wherein the interior of the shell body is filled with particle, powder, liquid, slurry, paste or dissolvable solid type contents (107), and the opening portion (201) of the selected container (200) is provided with a container cap (110), wherein the container cap (110) having an inner thread (111) is threadly engaged with the external thread (202) at the outside of the opening portion (201) of the selected container (200). The force bearing structure (104) can be constituted by an internally installed pushing structure (106), and the force bearing structure (104) is made of a flexible material softer than the one of shell body (101) to be combined on the top portion of the shell body (101), when the force bearing structure (104) having an extended pushing structure (106) being combined inside the shell body (101) pointing toward the closure (102) is tightenly forced during thread engagement, the pushing structure (106) is pushed toward said closure (102) thereby touchingly pressing the closure (102) combined with the dispense outlet (105) of the shell body (101) to open, and the closure (102) is further through the prestressed help by the flexible flake type structure (103) attached to the closure (102) and shell body (101) to open contents (107) inside the shell body (101) of the selected container (200) and keep said closure (102) remaining at a stable opening status even after disappearance of pressure, while the closure (102) is maintained at an opening status without falling down through the prestressed flexible flake type structure (103), wherein the selected container (200) can be empty without filling in contents or filled with particular contents. In view of the applications, the peripheral side of the shell body (101) is made with a protruded ring type dog or a radially protruded block type dog (109), the outside diameter of the dog (109) is slightly larger than the inside diameter of the opening portion (201) of the selected container (200) and is slightly smaller than the inside diameter of the container cap (110) so as to limit the depth of insertion for inserting the shell body (101) into the opening portion (201) of the selected container (200) and to form a limiting structure when it is pressed, while the outside diameter of the force bearing structure (104) at the top end of shell body (101) is also slightly smaller than the inside diameter of the container cap (110) so as to avoid hindering the thread insertion by the container cap (110) into the opening portion (201) of the selected container (200) for tightening advancement;

5. The sleeved to press-open type storage device with a prestressed to open closure can be inserted into the opening portion (201) of the selected container (200), wherein the opening portion (201) of the selected container (200) is provided with a container cap (110), the inside diameter of the container cap (110) and the outside diameter of the opening portion (201) of the selected container (200) can be tightenly pressingly combined and the interior of the shell body is filled with particle, powder, liquid, slurry, paste or dissolvable solid type contents (107), when said force bearing structure (104) is tightenly pressingly forced to deform during the tighten pressing combination process thereby producing inner pressure to open the closure (102) which is further through the prestressed help by the flexible flake type structure (103) attached to the closure (102) and shell body (101) to open contents (107) inside the shell body (101) of the selected container (200) and keep said closure (102) remaining at a stable opening status even after disappearance of pressure, while the closure (102) is maintained at an opening status without falling down through the prestressed flexible flake type structure (103), wherein the selected container (200) can be empty without filling in contents or filled with particular contents. In view of the applications, the peripheral side of shell body (101) is made with a protruded ring type dog or a radially protruded block type dog (109), the outside diameter of the dog is slightly larger than the inside diameter of the opening portion (201) of the selected container (200) and is slightly smaller than the inside diameter of the container cap (110) so as to limit the depth of insertion for inserting the shell body (101) into the opening portion (201) of the selected container (200) and to form a limiting structure when it is pressed, while the outside diameter of the force bearing structure (104) at the top end of the shell body (101) is also slightly smaller than the inside diameter of the container cap (110) so as to avoid hindering the pressing insertion by the container cap (110) into the opening portion (201) of the selected container (200) for pressing combination advancement;

6. The sleeved to press-open type storage device with a prestressed to open closure can be inserted into the opening portion (201) of the selected container 200, wherein the opening portion (201) of the selected container (200) is provided with a container cap (110), the inside diameter of the container cap (110) and the outside diameter of the opening portion (201) of the selected container (200) can be tightenly pressingly combined and the interior of the shell body is filled with particle, powder, liquid, slurry, paste or dissolvable solid type contents (107), and the force bearing structure (104) comprising an internally installed pushing structure (106) is made of a flexible material softer than the one of shell body (101) to be combined on the top portion of the shell body (101), when the force bearing structure (104) having an extended pushing structure (106) being combined inside the shell body (101) pointing toward the closure (102) is tightenly forced during the tighten pressing combination process, the pushing structure (106) is pushed toward said closure (102) thereby touchingly pressing the closure (102) combined with the dispense outlet (105) of the shell body (101) to open, and said closure (102) is further through the prestressed help by the flexible flake type structure (103) attached to the closure (102) and shell body (101) to open the contents (107) inside the shell body (101) of the selected container (200) and keep said closure (102) remaining at a stable opening status even after disappearance of pressure, while the closure (102) is maintained at an opening status without falling down through the prestressed flexible flake type structure (103), wherein the selected container (200) can be empty without filling in contents or filled with particular contents. In view of the applications, the peripheral side of the shell body (101) is made with a protruded ring type dog or a radially protruded block type dog (109), the outside diameter of the dog is slightly larger than the inside diameter of the opening portion (201) of the selected container (200) and is slightly smaller than the inside diameter of the container cap (110) so as to limit the depth of insertion for inserting the shell body (101) into the opening portion (201) of the selected container (200) and to form a limiting structure when it is pressed, while the outside diameter of the force bearing structure (104) at the top end of the shell body (101) is also slightly smaller than the inside diameter of the container cap (110) so as to avoid hindering the pressing insertion by the container cap (110) into the opening portion (201) of the selected container (200) for pressing combination advancement.

The present invention is further related to a sleeved to press-open type storage device with a prestressed to open closure which is an innovative cylinder, cylinder like, or multi-face can shaped hollow container structure for storing particle, powder, slurry, paste, liquid, or dissolvable solid type contents, wherein the peripheral side of the can shaped shell body having flanges for insertingly attaching with the edges of the opening portion is inserted into the opening portion of the selected container, while the position of the content dispense outlet on the shell body of a hollow container is made at one axial end of the shell body of the hollow can type container. The closure is combined with the content dispense outlet for the closure to be opened by hand, wherein when they are inserted into the opening portion of the selected container, contents is directly poured out into selected container, or to dissolve the solid type contents inside the shell body of the hollow container by means of the liquid or air inside the selected container. Further, a flexible flake type structure is made between the closure and the shell body of a hollow container to prevent the closure and the shell body from detachment, wherein the relatively stable relationship between the closure and shell body is that when the closure relative to the storage device appears a close status, the attaching flake type structure is bent to appear a prestressed status to the opening direction so that the closure can be kept at a stable opening status to avoid hindering the dispense of contents inside the shell body of the hollow container, whereas the closure is not detached from the shell body so as to mix with the dispensed contents after it is opened, therefore it is good for recycle.

Figure 10:
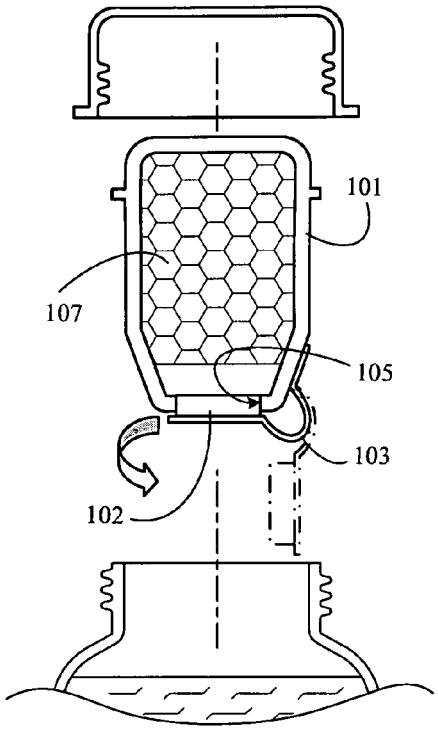
FIG. 10 is a cross-sectional view showing that the force bearing structure is not installed to the storage device with the prestressed to open closure of the present invention.

FIG. 10 is a cross-sectional view showing that the force bearing structure is not installed to the storage device with the prestressed to open closure of the present invention.

As illustrated in FIG. 10, it mainly comprises:

A shell body (101): It is a cylinder, cylinder like or multi-faced can type hollow container made of plastic or metal for storing particle, powder, slurry, paste, liquid or dissolvable solid type contents (107), wherein the peripheral side of the shell body (101) of a hollow container having flanges for insertingly attaching with the edges of the opening portion of the container is inserted into the opening portion (201) of selected container (200), and the shell body (101) of a hollow container being made with a dispense outlet (105) at one axial end thereof is at a close status when the dispense outlet (105) is combined with a closure (102), and dispenses contents (107) when said closure (102) is opened. Further, the shell body of the hollow container being attached with the flexible flake type structure (103) allows the position of said closure (102) to be at opening status in ordinary conditions and to appear a prestressed toward opening direction status when it is combined with the dispense outlet (105);

Said shell body (101) is not disposed with the force bearing structure (104), whereas the dispense outlet (105) thereof is arranged for disposing the closure (102), thereby to be opened by hand;

A closure (102): It appears a closure structure to matchingly combined with the dispense outlet (105) at bottom end of the shell body (101) to make the two appear a closing combined status, wherein the closure is opened by hand to dispense contents or to directly pour out contents, or to dissolve the solid type contents thereof by means of the liquid or air inside the selected container; the closing combining methods for said closure (102) and shell body (101) include: 1) plugging combination 2) in-laying combination 3) locking combination 4) adhering combination 5) fusion combination or clamping combination by additional auxiliary locking elements, etc.;

The definition of closing combination of said closure (102) and dispense outlet (105) of shell body (101) includes a full close status or semi-close status and is dependent on the property and the preservation requirement of the contents stored inside the shell body (101);

A flexible flake type structure (103): It is constituted by a flexible flake type attaching structure made of flexible material for attaching the shell body (101) and closure (102), wherein the attaching status of the shell body (101) and closure (102) includes that when the closure (102) is combined with the dispense outlet (105) at bottom end of the shell body (101) to allow the shell body (101) as a container to appear a close status, the flexible flake type structure (103) is bent to a prestressed status to the opening direction, wherein the closure (102) detaches from the shell body (101) and is helped by the prestressed flexibility of the flexible flake type structure (103) to allow the dispense outlet (105) at bottom end of the shell body (101) to maintain at a stable opening status to dispense contents (107), while the closure (102) is through the flexible flake type structure (103) to be still attached to the shell body (101) without falling down.

As illustrated in FIG. 10 is a cross-sectional view showing that the force bearing structure is not installed to the storage device with the prestressed to open closure of the present invention, wherein the structural relationships between the shell body (101), closure (102) and flexible flake type structure (103) include:

1. The flexible flake type structure (103), closure (102) and shell body (101) are made of the same material and are integrally formed; or
2. The closure (102) and flexible flake type structure (103) are made of the same material and integrally formed to further combine with the shell body (101) made of the same material; or
3. The closure (102) and flexible flake type structure (103) are made of the same material and are integrally formed to further combine with the shell body (101) made of different material; or
4. The shell body (101) and flexible flake type structure (103) are made of the same material and are integrally formed to further combine with the closure (102) made of the same material; or
5. The shell body (101) and flexible flake type structure (103) are made of the same material and are integrally formed to further combine with the closure (102) made of different material; or
6. The shell body (101), closure (102) and flexible flake type structure (103) are made of the same material, wherein they are individually made and further combined; or
7. The shell body (101), closure (102) and flexible flake type structure (103) are made of different material, wherein they are individually made and further combined.

The combining methods for said shell body (101) and closure (102) as well as the combining methods for said closure (102) and flexible type structure (103) include: fusion combination, adhering combination, rivet combination, mechanism like in-lay or locking combination, clamping or sewing combinations by additional auxiliary elements, etc.;

To sum up, the present invention discloses a sleeved to press-open type storage device with a prestressed to open closure having a peripheral side of the shell body (101) to be inserted into the opening portion of the selected container, wherein the peripheral side of the shell body (101) has flanges for insertingly attaching with the edges of the opening portion of said container. The shell body (101) is made with a dispense outlet (105) at the axial bottom end thereof to appear a close status when the dispense outlet (105) is combined with the closure (102), and to dispense contents (107) when said closure (102) is opened. Further, the closure and one side of the storage device is connectedly attached by a flexible flake type structure (103), wherein it is characterized in that when said closure (102) is closed relative to the dispense outlet (105) of the storage device, the connecting flake type structure (103) is bent to appear a prestressed status to the opening direction thereby allowing the attaching flexible flake type structure (103) to release the prestressed force so as to keep said closure (102) to remain at a stable opening status after it is pressed to open.

The invention claimed is:

1. A press-open storage device, comprising:

a hollow container structure including a shell body (101) for storing contents (107) comprising particles, a powder, a slurry, a paste, a liquid, or dissolvable solid contents and arranged to be pushed into an opening portion of a selected container, wherein said hollow container body includes flanges for engagement with edges of an opening of the selected container when the hollow container body is inserted into said opening of the selected container, said shell body including a dispensing outlet at an axial bottom end of the shell body;

a closure (102) arranged to fit into and close said dispensing opening of said shell body, said closure being attached to said shell body by a flexible structure (103);

a force bearing structure (104) at an axial top end of the shell body and a pushing structure (106) extending from said force bearing structure, said force bearing structure comprising a flexible portion of said shell body arranged to move axially and cause said pushing structure (106) to engage said closure (102) when an external force is applied to the force bearing structure and thereby apply pressure to said closure (102) to cause said closure to open and thereby dispense said contents into said selected container, wherein said pushing structure is a separate body from said closure, does not engage said closure until said external force is applied to the force bearing structure to cause the force bearing structure to press said closure, and is disengaged from said closure after said closure has opened to dispense said contents into said selected container, wherein the flexible structure (103) is fixedly attached to or integrally formed with the shell body and pre-stressed in an opening direction of the closure such that when said closure is fitted into said dispensing opening to close the dispensing opening, closing of the dispensing opening is maintained against a pre-stressing force applied by the flexible structure, and such that when said external force is applied to said force bearing structure, said pre-stressing force facilitates opening of the dispensing opening to ensure dispensing of said contents;

wherein said flexible portion of the force bearing structure is configured to engage a force applying member rotationally secured to said selected container for applying said external force to open said dispensing opening when said force applying member is turned relative to said selected container.

2. A press-open storage device as claimed in claim 1, wherein the flexible structure, shell body, and closure are made of a same material and integrally formed.

3. A press-open storage device as claimed in claim 1, wherein the flexible structure and closure are made of a same material and integrally formed, and said shell body is made of a same material as said flexible structure and closure.

4. A press-open storage device as claimed in claim 1, wherein the closure and flexible structure are made of a same material and integrally formed, and said shell body is made of a different material from said flexible structure and closure.

5. A press-open storage device as claimed in claim 1, wherein the shell body and flexible structure are made of a same material and integrally formed, and said closure is made of a same material as said shell body and flexible structure.

6. A press-open storage device as claimed in claim 1, wherein the shell body and flexible structure are made of a same material and integrally formed, and said closure is made of a different material from said shell body and flexible structure.

7. A press-open storage device as claimed in claim 1, wherein the shell body, closure, and flexible structure are made of a same material but are individually made and combined.

8. A press-open storage device as claimed in claim 1, wherein the shell body, closure, and flexible structure are made of different materials.

9. A press-open storage device as claimed in claim 1, wherein said shell body, closure, and flexible structure are combined by a method selected from the group consisting of fusion, use of an adhesive, riveting, provision of a locking or inlay mechanism, clamping, sewing, and use of additional combining elements.

10. A press-open storage device as claimed in claim 1, wherein said force bearing structure is formed by a flexible structure integrally with but thinner than a material of said shell body.

11. A press-open storage device as claimed in claim 1, wherein said pushing structure is integral with said force bearing structure.

12. A press-open storage device as claimed in claim 1, wherein said flanges are in the form of a protruding structure on a periphery of the shell body to limit a depth of insertion of the shell body into the selected container.

13. A press-open storage device as claimed in claim 1, wherein the force applying member is a container cap having a generally flat surface for uniformly engaging the flexible portion of the force bearing structure.

14. A press-open storage device as claimed in claim 13, wherein said container cap is threadingly coupled to said selected container.

* * * * *